United States Patent [19]

Morris et al.

[11] Patent Number: 4,733,033

[45] Date of Patent: Mar. 22, 1988

[54] MOLDED CASE CIRCUIT BREAKER CONTACT ARRANGEMENT INCLUDING A SPRING CLIP CONTACT ARM RETAINER

[75] Inventors: Robert A. Morris, Burlington; James M. Mitsch, West Hartford; Irenaeus S. Panus, New Britain; Yuet-Ying Yu, Waterbury; Roger N. Castonguay, Terryville, all of Conn.

[73] Assignee: General Electric Company, New York, N.Y.

[21] Appl. No.: 941,974

[22] Filed: Dec. 15, 1986

[51] Int. Cl.[4] ..... H01H 9/00; H01H 3/62

[52] U.S. Cl. ..... 200/153 G; 200/244; 200/272; 200/285; 200/267

[58] Field of Search ..... 200/250, 244, 245, 247, 200/271, 272, 273, 274, 260, 267, 285, 153 G

[56] References Cited

U.S. PATENT DOCUMENTS

| | | | |
|---|---|---|---|
| 2,962,573 | 11/1960 | Scully | 200/260 |
| 3,004,125 | 10/1961 | Prien et al. | 200/244 |
| 3,287,533 | 11/1966 | Rys | 200/272 X |
| 3,564,184 | 2/1971 | Gauthier et al. | 200/244 |
| 3,586,808 | 6/1971 | Shibata et al. | 200/267 X |
| 4,243,852 | 1/1981 | Larson | 200/267 X |
| 4,482,877 | 11/1984 | Castonguay et al. | 200/244 X |
| 4,679,016 | 7/1987 | Ciracia et al. | 335/132 |

FOREIGN PATENT DOCUMENTS

| | | | |
|---|---|---|---|
| 210470 | 4/1974 | Japan | 200/267 |

*Primary Examiner*—Henry J. Recla
*Assistant Examiner*—Ernest G. Cusick
*Attorney, Agent, or Firm*—Richard A. Menelly; Walter C. Bernkopf; Fred Jacob

[57] ABSTRACT

A molded case circuit breaker movable contact arm or carrier electrically connects with the circuit breaker trip unit or load terminal without requiring a flexible electrical conducting braid. The contact carrier is pivotally arranged within a contact carrier support to which the trip unit or load terminal lug is attached. The contact carrier pivot pin is supported on a pair of parallel posts extending from the contact carrier and a spring clip is positioned around the parallel posts and the pivoting end of the contact carrier to promote good electric transport without interfering with the rotational movement of the contact carrier.

15 Claims, 7 Drawing Figures

MOLDED CASE CIRCUIT BREAKER CONTACT ARRANGEMENT INCLUDING A SPRING CLIP CONTACT ARM RETAINER

BACKGROUND OF THE INVENTION

Complete automation of molded case circuit breaker components by robotic assembly have not heretofore been completely successful. One impediment to complete robotic assembly is the attachment of a flexible conductive braid between the circuit breaker contact carrier and the circuit breaker trip unit or load terminal lug.

Early attempts to eliminate the electrical contact braid are found in U.S. Pat. Nos. 3,023,292, 3,033,964 and 3,073,936 wherein a pair of contact carriers are supported on a contact arm carrier support by means of a pivot pin and a thick spring clip is fastened to the carrier support and arranged around both the contact carriers and the carrier support. Direct electrical connection between the spring clip and the terminal conductor in some higher current industrial rated circuit breaker designs advantageously improves the electrical conduction between the terminal conductor and the movable contact arm by the electromagnetic forces of attraction generated by the current through the spring clip. The increasing electric current increases the electromagnetic force on the juncture between the movable contact arm and the terminal conductor to create an increasing compressive force therebetween. In other designs, such as required in certain lower current rated current limiting industrial circuit breaker designs, the forces exerted by the spring clip on the movable contact arm and the terminal conductor must remain relatively constant with increasing current to ensure that the contacts can be electrodynamically repulsed and separated under high current faults such as those occurring with short circuits. The contact arm must rapidly move about its pivot in the early stages of the current waveform to separate the contacts with minimum let-through current at the instant of separation. This is not easily obtained when the compressive forces on the movable contact arm and the terminal conductor substantially increase at the time the movable contact arm is required to rotate about its pivot.

U.S. Pat. Nos. 4,240,053 and 4,554,427 each disclose a circular segment formed within the movable contact carrier and are arranged over a circular segment formed on the terminal conductor to form a conductive junction between the contact carrier and the terminal conductor.

U.S. Pat. No. 4,160,142 utilizes a pair of washers, a nut and a bolt to connect the movable contact carrier to the terminal conductor to electrically connect the contact carrier with the terminal conductor.

U.S. Pat. No. 4,245,203 discloses a clinch type electrical connection between the movable contact arm and a bifurcated pair of upright posts. Clamping force upon the contact arm pivot is provided by the resilience of the posts and by a bias spring clip.

SUMMARY OF THE INVENTION

A molded case circuit breaker movable contact carrier is mechanically and electrically connected with a contact carrier supported by insertion of the pivoting end of the contact carrier within a pair of posts extending from the carrier supports. A steel spring clip is inserted over the end of the contact carrier and the posts on the carrier support to bias the end of the contact carrier to the posts for good electrical connection therebetween, while allowing the carrier support to readily rotate between the posts. One embodiment of the spring clip includes an additional arm extending between a pair of sidearms. The additional spring clip arm is sized to separate the posts on the carrier support prior to insertion of the end of the contact carrier to simplify the insertion of the carrier support within an automated assembly process.

BRIEF DESCRIPTION OF THE DRAWINGS

FIG. 6 is a top perspective view of an alternate embodiment of the movable contact arm carrier support depicted in FIG. 2.

DESCRIPTION OF THE PREFERRED EMBODIMENT

Figure 1:
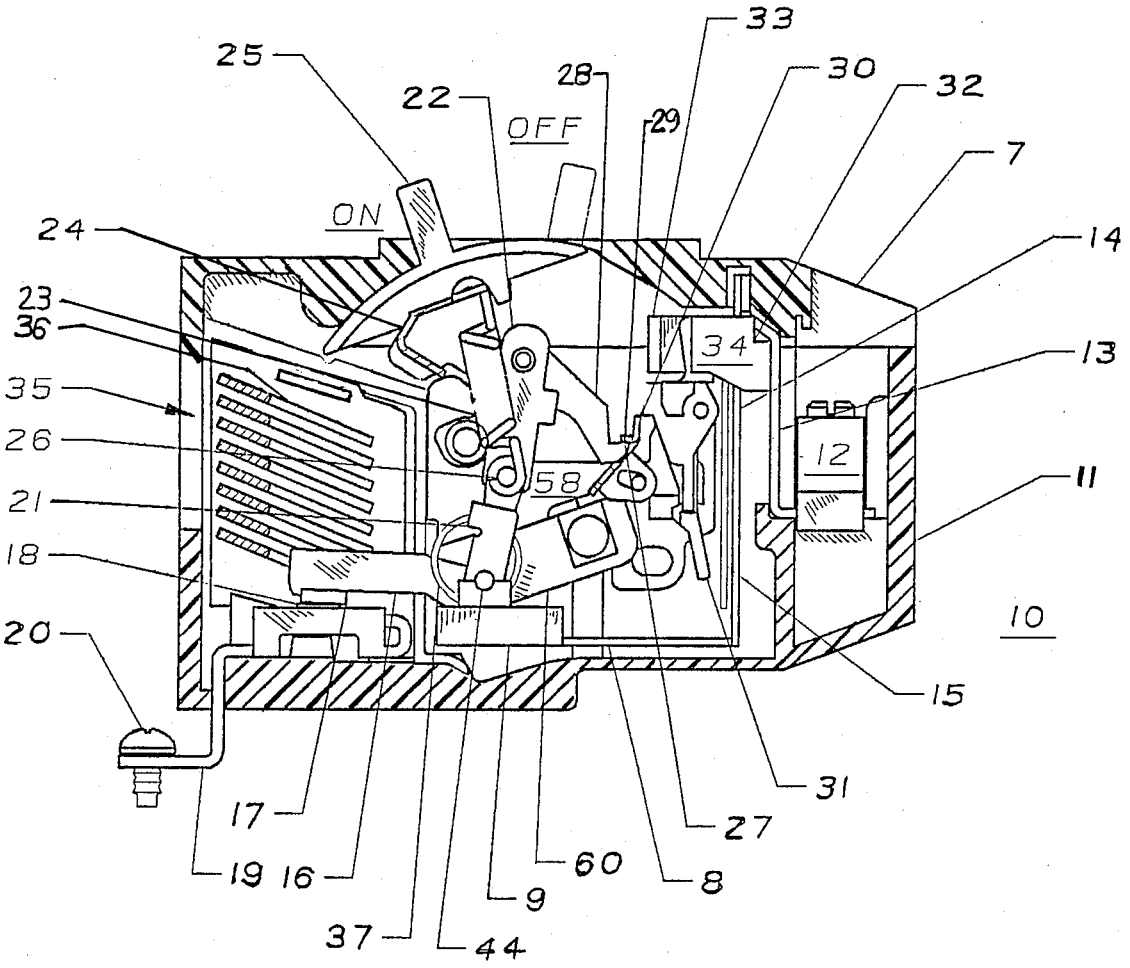
FIG. 1 is a side view, in partial section, of a molded case circuit breaker containing the movable contact arm arrangement, according to the invention.

A molded case circuit breaker 10 is shown in FIG. 1 wherein a plastic cover 7 and case 11 support a load lug 12 at one end, which is connected to a heater 14 by means of a load strap 13. A thermally responsive element such as a bimetal 15 is arranged ahead of the heater and in thermal proximity therewith. The heater electrically connects with a movable contact arm or carrier 16, hereafter "contact carrier", by means of a contact carrier support 9, which is electrically connected with the heater by means of a rigid conductor 8. To promote good electrical conductivity, the contact carrier is made of copper or a copper alloy. The contact carrier is arranged to pivot about a pivot pin 44 upon the occurrence of a severe overcurrent condition independent of the circuit breaker operating mechanism, which is generally depicted at 58. The electric circuit through the breaker is completed by the transfer of current between the movable contact 17 attached to the contact carrier and a fixed contact 18, which connects with the line terminal screw 20 by means of the line terminal strap 19. The contact carrier connects with the operating mechanism by means of a lower link 21, which in turn connects with an upper link 22 through a toggle pin 26. A pair of operating springs 23 connect between the toggle pin and the operating handle yoke 24, one on each side of the upper link, and are moved overcenter from the ON and OFF positions by means of an operating handle 25. The contacts are held in the closed position by means of a cradle 28, which engages a primary latch 29 by means of a cradle hook 27 formed at one end of the cradle, as fully described in U.S. Pat. No. 4,679,016, entitled "Interchangeable Mechanism For Molded Case Circuit Breaker" which patent is incorporated herein for purposes of reference. The primary latch is, in turn, captured by a secondary latch 30, which responds to the motion of a trip bar 31 to first release the secondary latch and then the primary latch, whereby the cradle is free to rotate in a counterclockwise direction as the toggle pin collapses under the bias provided by the operating springs. A crossbar 60 connects with the lower link 21 by means of the pivot pin 44 and serves to interconnect the separate poles of a multipole circuit. A complete description of the operation of the crossbar assembly is found within the aforementioned U.S. patent application. The magnetic trip unit 34 which encompasses the heater 14 responds to severe overcurrent conditions through the breaker causing the armature 33 to move into contact with the trip bar 31 to articulate the operating mechanism. The bimetal 15 contacts the trip bar 31 in response to less severe overcurrent conditions which persist for a predetermined time duration. The contact spring 37, which encompasses the contact carrier, is designed to hold the movable and fixed contacts 17, 18 in good electric connection under normal operating conditions, yet allow the contact carrier to rapidly rotate independent of the operating mechanism under the forces of electrodynamic repulsion generated between the line strap 19 and the contact carrier upon short circuit overcurrent conditions before the magnetic trip unit and bimetal respond. Upon the instant of separation between the fixed and movable contacts, an arc is formed therebetween which motivates into the arc chute 35 wherein it becomes deionized and cooled upon impingement with the metal arc plates 36.

Figure 2:
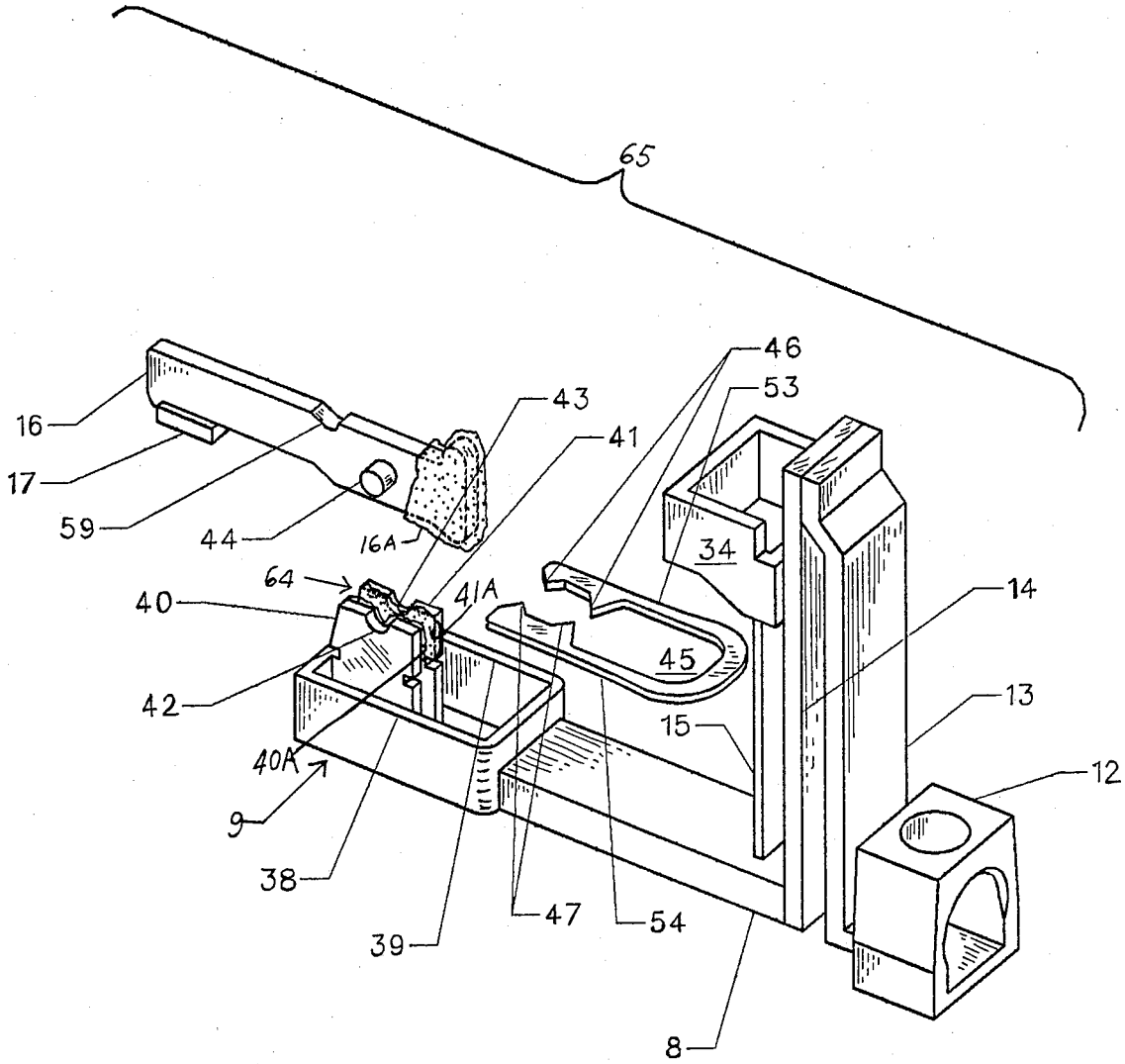
FIG. 2 is a top perspective view, in isometric projection, of the movable contact arm arrangement depicted in FIG. 1.
Figure 3:
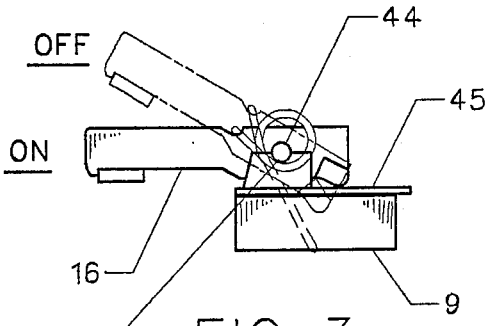
FIG. 3 is a side view of the movable contact arm in OPEN and CLOSED positions.

The unitary relationship between the load strap 13, heater 14, rigid conductor 8 and contact carrier support 9 can best be seen by referring now to FIGS. 2 and 3. These components are welded or brazed together and are downwardly inserted within the circuit breaker case in a single operation. A spring clip 45 made from a copper or iron alloy is positioned outboard of the support posts such that the protrusions 46, 47 formed on the side arms 53, 54 capture the posts therebetween. The trip unit assembly 65, as an integral arrangement of the magnetic trip unit 34, bimetal 15, heater 14 and contact carrier support 9, is next positioned within the circuit breaker case. The spring clip itself can be fabricated from a shaped memory alloy such as nickel-titanium alloy or a brass alloy such as described within U.S. Pat. No. 4,524,343 entitled "Self-Regulated Actuator", which patent is incorporated herein for reference purposes. The shaped memory alloy then provides a tension force on the sidearms 53, 54 upon reaching a predetermined temperature above a selected current level, thereby causing the sidearms to bend toward each other. The contact carrier is next inserted within the upstanding posts 40, 41 integrally formed and extending upward from the contact carrier support side arms 38, 39 such that the pivot pin 44 nestles within the grooves 42, 43 formed on the top surface of the posts. The interface copper substrate surfaces 40A, 41A between the posts and the contact carrier can be coated with a layer 16A of silver to decrease the electrical resistance therebetween or tin to maintain an oxide free surface. When a suitable lubricant, such as a coloidal dispersion of graphite particles in water or grease, is applied to the pivot end of the contact carrier subjacent the pivot pin, the contact carrier is easily rotated from its ON to its OFF position, as indicated in phantom, without deterring from the good electrical connection provided between the contact carrier and the contact carrier support imparted by the tension exerted by the side arms of the spring clip. Alternatively a coating of a silver and graphite mixture can be plated or sprayed onto the copper substrate surface. The parallel arrangement of the contact carrier support arms allows the circuit current to divide between the arms and thereby generates an attractive electromagnetic force. The induced electromagnetic force increases the pressure exerted between the contact carrier and the contact carrier support posts to eliminate the occurrence of arcing between contact carrier arms and the support posts upon extreme overload conditions.

Figure 4:
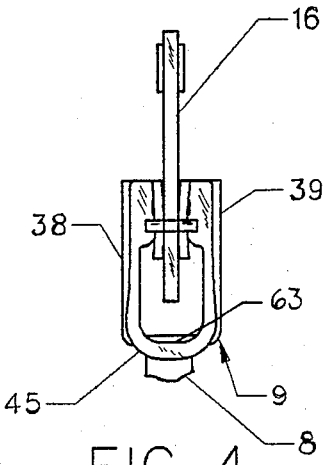
FIG. 4 is a front view of the movable contact arm depicted in FIG. 3.

The unitary curvilinear-U-shaped structure of the contact carrier support 9 is best seen by referring now to FIGS. 2 and 4. The sidearms 38, 39 of the contact carrier support are integrally joined by a bight 63 at one end and terminate at the opposite end in a pair of posts 40, 41 which are formed from the same unitary piece and extend perpendicular from the top of the sidearms.

Figure 5B:
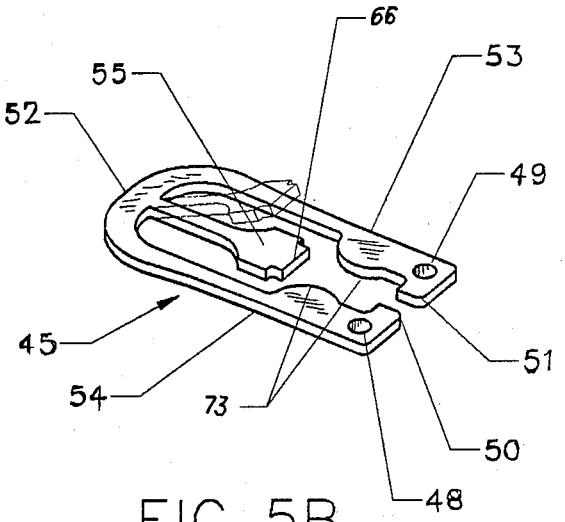
FIG. 5B is a top perspective view of an alternate embodiment of the spring clip depicted in FIG. 5A.
Figure 5A:
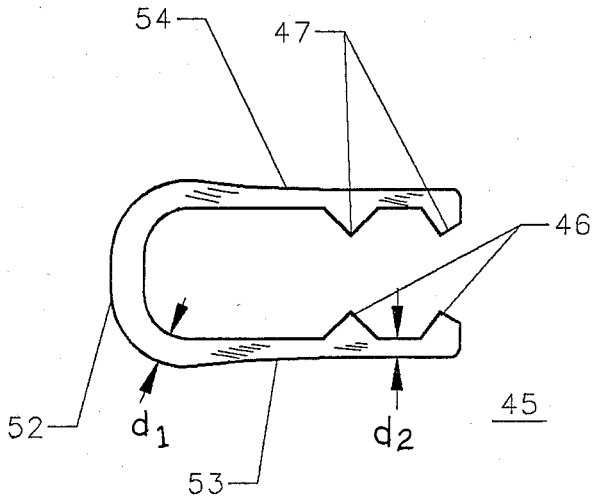
FIG. 5A is a plan view of the spring clip shown in FIG. 1.

Referring now to FIG. 5A, the planar spring clip 45 is depicted as a U-shaped configuration wherein a pair of adjacent sidearms 53, 54 are integrally joined by a bight 52 at one end. The width at the bight end of the sidearms, indicated at $d_1$, is greater than the width $d_2$ at the opposite end to ensure a uniform stress distribution along the sidearms.

To facilitate the downward loading of the contact carrier 16 within the slot 64 defined between posts 40, 41, shown earlier in FIG. 2, the trifurcate spring clip arrangement 45 depicted in FIG. 5B is employed. An additional intermediate arm 55 is formed between the sidearms 53, 54 and extends in the same plane as the side arms from the bight 52. The width of the additional arm is slightly larger than the width of the slot 64 and holds the slot open until the contact carrier is inserted within the slot, which thereby displaces the additional leg out of the slot, leaving the contact carrier in a press-fit relation therein. The additional arm, which is lanced from the same steel sheet from which the sidearms 53, 54 are formed can be in the same plane as the sidearms or offset from and extend a greater distance in the vertical plane than the sidearms, as indicated in phantom. The trifurcate spring clip differs from the spring clip depicted earlier by using a pair of protrusions 73 formed along the sidearms and a pair of tabs 50, 51 formed at the ends of the sidearms to trap the posts 40, 41 shown in FIG. 2 after the additional arm is displaced by the contact carrier 16. The holes 48, 49 formed within the tabs facilitate the implementation of a separation tool to expand the sidearms sufficiently apart to allow for clearance over the posts. The tongued extension 66 at the end of the intermediate arm 55 is the only part of the intermediate leg that extends within the slot 64. Preinserting the spring clip over the contact carrier support 9 with the slightly oversized additional extension 65 between the posts 40, 41 sufficiently expands the slot 64 such that the movable contact carrier 16 readily fits within the slot. When the contact carrier is inserted between the posts, the additional arm is displaced out of the-slot and is forced down within the cruciform slot 67 defined between the flat sidearms 68, 69 shown integrally formed within the carrier support 9 depicted in FIG. 6, before welding to the trip unit assembly 65 of FIG. 2. This carrier support differs from the earlier carrier support by the omission of the semicircular grooves 42, 43 described earlier with reference to FIG. 2. The upstanding radial sidearms 71, 72 formed at the ends of the flat side arms are joined by a flat light 70 which is shaped and formed in a single operation from a single piece of copper stock. A pair of arcuate slots 56, 57 are cut into the sidearms to increase the flexiblity of the sidearms and to allow the sidearms to be separated without taking a set.

The slotted configuration of the contact carrier support 9, as shown in FIG. 6, provides even greater flexibility to the sidearms 38, 39 by reducing the amount of material in the vicinity of the region between the sidearms 38, 39 and the bight 63. A pair of arcuate slots 56, 57, formed therein, facilitates the separation of posts 40, 41 when the movable contact arm carrier is inserted within the slot, without decreasing the contact pressure provided between the posts 40, 41 and the contact carrier, by the spring clip.

Having thus described our invention, what we claim as new and desire to secure by Letters Patent is:

1. A molded case circuit breaker comprising:

a stationary contact carrioer member having a stationary contact affixed at one end thereof and a terminal lug at an opposite end thereof for connection with an external circuit;

a movable contact carrier support comprising a shaped metal bar having a pair of spaced parallel posts extending from one end;

a movable contact carrier comprising a contact end and a pivot end and having a movable contact affixed at said conatct end and a pivot pin within said pivot end, said pivot end of said movable contact carrier being movably retained between said spaced parallel posts;

an operating mechanism connected with said movable contact carrier to lift said movable contact away from said stationary contact and interrupt circuit current through said stationary and movable contacts;

means for sensing circuit current through said contacts and articulating said operating mechanism when said circuit current reaches a predetermined threshold; and spring clip retainer means arranged in press-fit relation around said spaced parallel posts and said movable contact carrier pivot end to hold said movable contact carrier pivot end in electrical contact with said spaced parallel posts, said spring clip retainer means comprising a U-shaped flat metal strip terminating in a pair of spaced arms which are connected at one end by a bight portion, said spaced arms being co-planar with each other and with said bight portion.

2. The molded case circuit breaker of claim 1 wherein each of said arms includes a pair of projections extending from and coplanar with said arms for capturing said spaced parallel posts and for providing electromagnetic attraction between said movable contact carrier and said spaced parallel posts.

3. The molded case circuit breaker of claim 2 wherein said spring retainer clip includes an additional arm intermediate said spaced arms, a part of said additional arm having a width greater than a space defined between said spaced parallel posts.

4. The molded case circuit breaker of claim 3 wherein said movable contact carrier support sidearms include a pair of planar surfaces supporting said spaced parallel posts.

5. The molded case circuit breaker of claim 4 wherein said carrier support sidearms define a cruciform slot intermediate said sidearms, said part of said additional arm being displaced within said cruciform slot.

6. The molded case circuit breaker of claim 5 wherein said additional arm part includes a tongued extension.

7. The molded case circuit breaker of claim 3 wherein said spring clip additional arm is inserted within said carrier support defined space prior to insertion of said movable contact carrier to facilitate insertion of said movable contact carrier.

8. The molded case circuit breaker of claim 7 displaces said spring clip additional arm from said contact support defined space.

9. The molded case circuit breaker of claim 3 wherein said additional arm is lanced from said spring retainer clip.

10. The molded case circuit breaker of claim 3 wherein said additional arm extends a greater distance in the vertical plane than said pair of spaced arms.

11. The molded case circuit breaker of claim 1 wherein said movable contact carrier support comprises a continuous metal bar formed into a pair of side arms defining a bight portion between said side arms.

12. The molded case circuit breaker of claim 11 including arcuate slots formed within said movable contact carrier support side arms proximate said bight portion to provide flexibility to said side arms.

13. The molded case circuit breaker of claim 1 including a lubricant between said spaced parallel posts and said movable contact carrier pivot end.

14. The molded case circuit breaker of claim 1 wherein said spaced parallel posts include a semicircular slot on a top surface for receiving said pivot pin extending through said movable contact carrier pivot end.

15. The molded case circuit breaker of claim 1 wherein each of said spaced arms uniformly decrease in width along their lengths to provide a corresponding uniform distribution of stress along said spaced arms.

* * * * *